US010737912B2

(12) United States Patent
Conci

(10) Patent No.: US 10,737,912 B2
(45) Date of Patent: Aug. 11, 2020

(54) RELEASE AND AUTOMATIC TURN HOOK SYSTEM FOR A BAG

(71) Applicant: Daniel Horacio Conci, Cordoba (AR)

(72) Inventor: Daniel Horacio Conci, Cordoba (AR)

( * ) Notice: Subject to any disclaimer, the term of this patent is extended or adjusted under 35 U.S.C. 154(b) by 0 days.

(21) Appl. No.: 16/524,253

(22) Filed: Jul. 29, 2019

(65) Prior Publication Data

US 2020/0031631 A1 Jan. 30, 2020

Related U.S. Application Data

(60) Provisional application No. 62/711,840, filed on Jul. 30, 2018.

(51) Int. Cl.
*B66C 1/22* (2006.01)

(52) U.S. Cl.
CPC ..... *B66C 1/226* (2013.01)

(58) Field of Classification Search
CPC ..... B66C 1/226; B66C 1/54
USPC ..... 294/81.54, 67.33, 67, 93, 95, 15, 81.62, 294/81.55, 81.56; 269/52; 414/607; 452/189, 192
See application file for complete search history.

(56) References Cited

U.S. PATENT DOCUMENTS 1,172,489 A * 2/1916 Schellnger ..... A22B 5/06 452/189
1,500,904 A * 7/1924 Thomas ..... B66C 1/22 294/67.31
1,506,827 A * 9/1924 Gellert ..... B66C 1/422 294/106
2,370,482 A * 2/1945 Weld ..... B66C 1/54 294/97
2,696,317 A * 12/1954 Toffolon ..... B66F 9/061 414/607
2,951,725 A * 9/1960 St Jean ..... B66C 1/32 294/97
3,287,057 A * 11/1966 Gallapoo ..... B66C 1/54 294/81.62
5,036,893 A * 8/1991 Decrane ..... B65B 67/1227 141/10
5,269,579 A * 12/1993 DeCrane ..... B66C 1/10 24/68 CD
5,304,091 A * 4/1994 Wilkinson ..... A22B 5/06 452/189
5,476,300 A * 12/1995 Dodge ..... B66C 1/54 294/67.33
6,161,600 A * 12/2000 Borkes ..... B65B 1/06 141/10

(Continued)

*Primary Examiner* — Paul T Chin
(74) *Attorney, Agent, or Firm* — Defillo & Associates, Inc.; Evelyn A Defillo

(57) ABSTRACT

A hanger with automatic triggering mechanism for lifting big-bags with multiple handles which includes a plurality of inverted hooks provided in the ends of the respective arms by a simple drive of the individual closing lever over the arms, thus achieving the closing of the bottom opening of the inverted hooks and holding the big-bag handles, and allowing to disengage the big-bag handles with a simple operation gesture of resting the hanger arms against the load, or shaking of the hanger, or pulling a manual lever, in that order of convenience, so that the automatic triggering mechanism triggers in an automatic way and then the retraction of the sliding latches is achieved thus releasing the handles.

3 Claims, 2 Drawing Sheets

(56) References Cited

U.S. PATENT DOCUMENTS 7,223,058 B2 * 5/2007 Nyhof ..... B65B 69/0091
414/415

* cited by examiner

RELEASE AND AUTOMATIC TURN HOOK SYSTEM FOR A BAG

TECHNICAL FIELD

This invention is related to a device intended to lift and transport loads, and more specifically, this invention refers to a device of the kind known as hanger, which allows lifting and transportation of the big-bags, commonly known as jumbo bags, or flexible intermediate bulk container (FIBC), and even more specifically, this invention stands out because of the convenient mechanism of fast releasing of the load.

BACKGROUND

Those skilled in the art well know that the market currently offers devices for lifting and transporting big-bags, commonly referred as lifting cross frames, which comprise radially extended arms that generally coincide in their ends with the handles of the big-bag with traditional hooks by holding the handles entering from above and consequently remain in their position due the pulling effect obtained by the load weight, usually achieving the disengagement of the handles of said big-bags by means of the shaking of the lifting cross frame or otherwise the operator has to descend from the transportation vehicle to disengage each of the handles.

It is therefore that the several variations of design of the traditional hangers or lifting cross frames has evolved in capacity, shapes, but these have always kept the principle of functioning and structure known in the market, that is, with the traditional hooks for upper enlace of the handles and with the subsequent manual maneuvers for hooking and disengaging by an operator near the load itself with the risks and handling times this involves.

Consequently, the present inventors, in the light of market needs and having obtained surprising results by means of the hanger proposed herein, understand they have at disposal a novel and inventive device which allows to perform engagement and disengagement safer and faster operations than the Prior Art and at the same time guaranteeing a safe transportation with effective engagement of the handles of the big-bags since these handles are not only hooked but they are effectively retained and held by means of some advantageous inverted hooks with bottom closure by sliding latches.

BRIEF DESCRIPTION OF THE INVENTION

A objective of this invention is to provide a hanger for hoisting big-bags with multiple handles which allows disengaging the big-bag which is being held and transported without descending from the vehicle at the moment of unloading, by means of a single operation gesture of resting the hanger or shaking.

Another objective of this invention is to provide a hanger for lifting ensuring the safe hooking of the handles of the big-bag that is being held on the hanger, avoiding an unexpected escape. The invention provides a hanger with automatic triggering mechanism for lifting big-bags with multiple handles which comprises a plurality of arms which protrude longitudinally and radially finishing in their ends in respective hooks characterized in that said plurality of arms protrude longitudinally and radially from a central tubular casing and each of the hooks is an inverted hook which bottom opening can be closed by means of a sliding latch thus allowing to achieve: an open hook position which is obtained in an automatic way by lowering a central passing-through pin being able to slide vertically inside said central tubular casing, wherein said central passing-through pin includes a downwards recess in diameter forming a triggering scale able to push downwards the bottom end of each of a plurality of pivoting triggers, in such a way that said sliding latch an intermediate hinged arm and said pivoting trigger are misaligning and therefore provoking the retraction of said sliding latch towards the position of open hook, and a closed hook position which corresponds with the alignment of said sliding latch said intermediate hinged arm and said pivoting trigger by means of the sliding of a closing lever, remaining the innermost end of said pivoting trigger interfering with the vertical movement path of said triggering scale of said central passing-through pin.

Therefore, it is a purpose of this invention to improve safety conditions when big-bags with multiple handles are handled, therefore improving the handling of big-bags, thus avoiding the operator to perform manual operations of adjustment and disengaging of said big-bags, and then a single operator is able to perform all the handling operations of said big-bags with the hanger purpose of this invention.

It is therefore an advantage of this invention to reduce the contact of the operator with the content of the big-bags, especially when the big-bags contain chemical or toxic substances.

Furthermore, it is an advantage of this invention that a big-bag held by means of a hanger like the one proposed herein can be accommodated in a correct position before disengaging, and that said disengaging can only be performed once the big-bag has released its weight.

In the event of emptying the big-bags of the kind which include a bottom discharge port that can be opened to unload the product contained inside, even being said big-bags hanging at a height in a unloaded state, said big-bags can be disengaged by pulling a lever, still more at a distance by means of a rope, providing therefore also a manual disengaging.

DETAILED DESCRIPTION OF THE INVENTION

Figure 1:
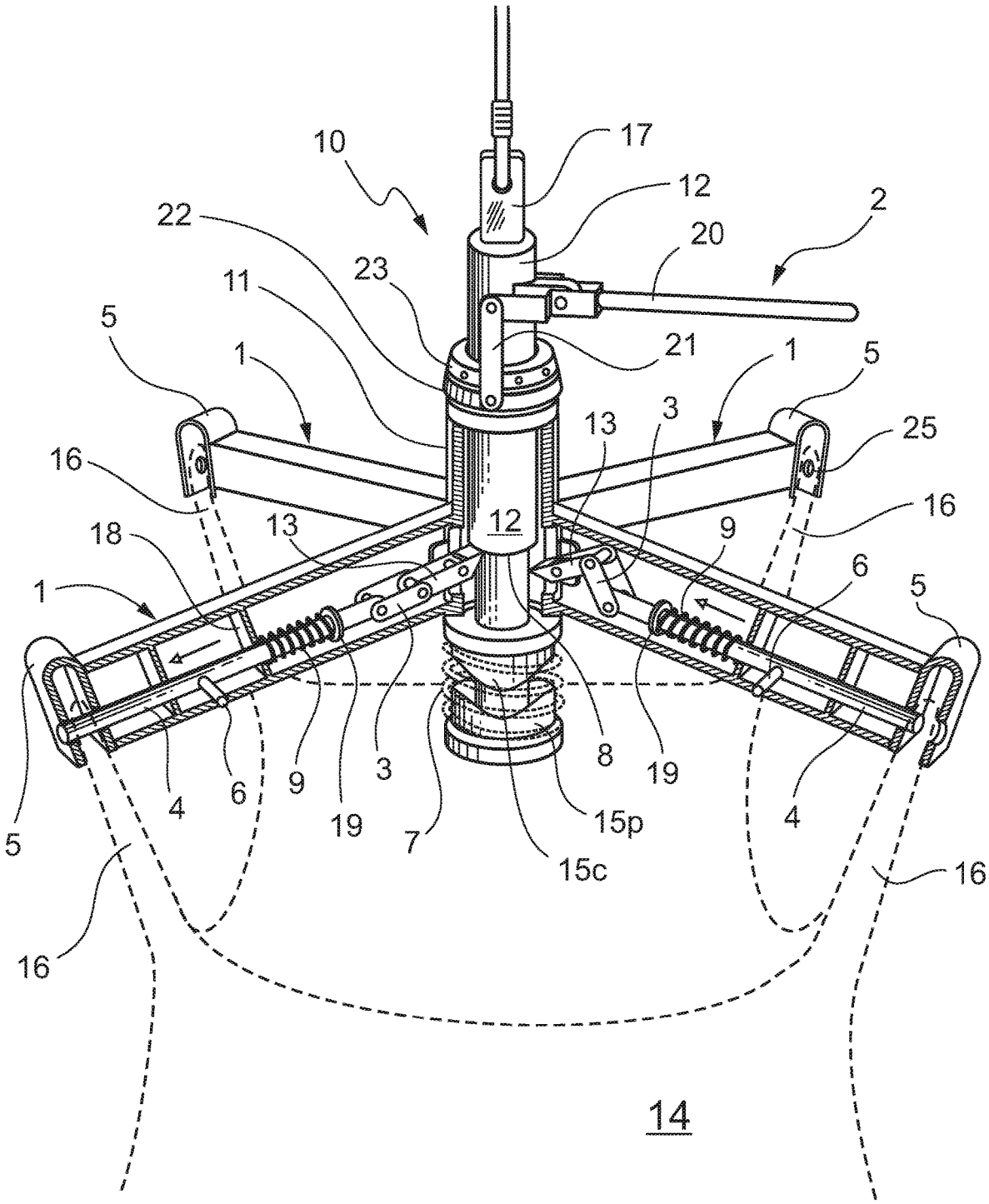
FIG. 1, is a perspective view and partially cut of the hanger for hoisting accordingly to a first preferable embodiment of the present invention, showing a dashed line hanging big-bag, and two possible position of latches, the one on the left in a position of closed latch, or "closed hook", and the one on the right in the position of opened latch, or "open hook"

As shown in FIG. 1, this invention comprises a hanger (10) for lifting big-bags (14) with multiple handles (16). As those skilled in the art well know, this kind of big-bags for bulk cargo of several products generally include four handles, strips, straps or lugs from which it is feasible to hold the bag for transportation.

Since four handle big-bags are one of the most commonly used kind of bags, four arms (1) hanger has been exemplified. Nevertheless, it is possible to extend the premises of this invention to a greater number of arms, or even less number of arms. As it can be seen in the figures attached, said arms are tilted in a descending manner towards their ends in an angle (A), which has demonstrated to be a highly convenient design since, among other issues, this enables the same handles (16), once fixed in position, to help keeping in a holding position the sliding latches (4) through friction and dragging of the same and in the manner further developed.

Said arms (1) are attached to a central casing (11) from which they protrude longitudinally and radially finishing in their ends in respective hooks, which for the purposes of this invention are inverted hooks (5). Said casing is generally tubular and allows the inner sliding of a central passing-through pin (12) from which it is possible to keep the whole hanger (10) hanging, since in the upper end of said central passing-through pin (12) a connecting means (17) is arranged, like an eyelet in such a way that the hanger can be connected to a vehicle or crane hook. Said connecting means (17) can be properly supported on a beam or similar to be held by a vehicle like a lift truck.

The central passing-through pin (12) is not merely an shaft, it includes a recess (8) in the diameter or perimeter, which reduces the diameter or perimeter downwards and which for the purposes of this invention constitutes a "triggering stage" or pushing shoulder, which shall be further described in its functioning below. For the reference of the reader, the reduction in diameter for the expected overall size for this kind of hangers can be enough in an amount of about 1 cm (0.4") towards each side of the diameter of the central passing-through pin (12).

Figure 3:
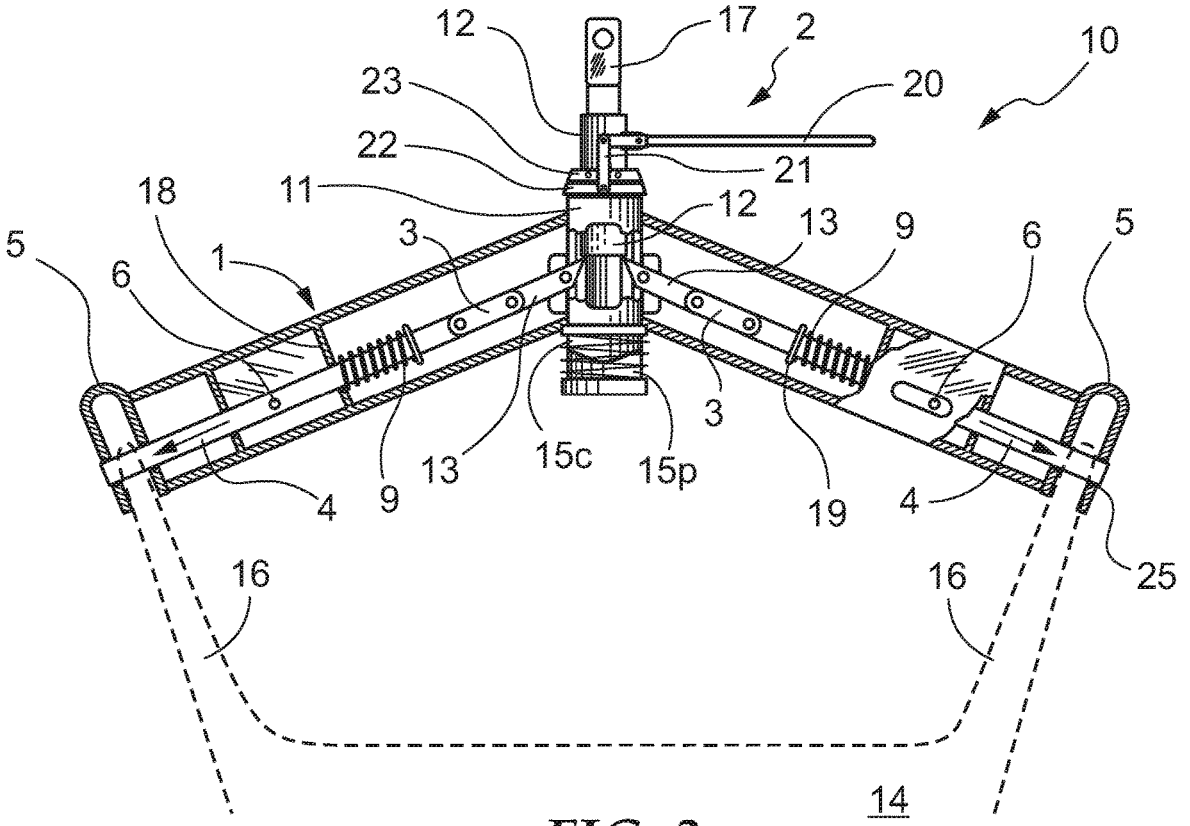
FIG. 3 is a side view of a partial cut of the lifting hanger purpose of this invention according to said first preferable embodiment, which shows a bag with multiple handles and hanging from them, illustrated in dashed lines, with the latches in a close position.

The bottom end of the central tubular casing (11) includes a tubular hub in a "crescent" shape which forms an axial cam (15*c*) of the casing, which axial support track corresponds with the axial support track of a bottom axial cam (15*p*) of the central passing-through pin (12). The fitting track between cams is a wavy track or tilted plane conveniently selected, so that, when pressing one cam against the other, an rotational adjustment is produced until a complete fit and immobilization of the set is achieved. In this way, when arms (1) from hanger (10) are loaded with the weight of the big-bag (14), an adjustment through fitting is achieved between the axial cams of the casing and the pin (15*c*, 15*p*) therefore positioning the big-bag in a correct manner for transportation. This can be seen in FIG. 3.

On the contrary, the separation of both axial cams (15*c*, 15*p*), is produced when the central passing-though pin (12) slides with respect to the casing (11) helped by the insertion of a bottom spring (7) shown in an schematic manner for the purposes of clarity and which activates helping to separate both axial cams (15*c*,15*p*) when the arms are released from the load exerted by the big-bag which is being held, for example when supporting the bag over a surface.

The engaging manner of the handles (16) of a big-bag is performed as follows: The arms (1) are configured to enable the radial movement of the corresponding sliding latches (4) which can lean out above an end of the arm (1) going through some inverted hooks (5) in the ends of the arms and which, for the purpose of this invention, have the shape of inverted forks, that is to say an inverted "U". Thus, it is possible to engage each handle (16) inserting them in the manner of a loop inside the corresponding inverted hook (5) and moving this by means of a lever (6) the corresponding sliding latch (4). In this way, each handle (16) remains held within the corresponding inverted hook (5), (See FIG. 1, left arm in closed position, or FIG. 3, both latches in closed position). It is clear that, to achieve the passing through of the inverted hooks (5), said hooks shall bear some passing holes (25) properly performed, although these may be end housings which allow the latches to house or fit in the hooks in such a way that they block the bottom opening, among other options.

Therefore, it is possible to achieve the above mentioned hooking since the central passing-through pin (12) with vertical movement path, is hanging and therefore, the triggering scale (8) obtained by the recess in diameter/perimeter is sufficiently placed above a plurality of pivoting triggers (13) in such a way that the same can be aligned with the corresponding sliding latches (4) by operating the closing levers (6). The pivoting triggers (13) are connected to the corresponding sliding latches (4) by means of some corresponding intermediate hinged arms (3) in such a way that they remain aligned and in the closed hook positions with a simple thrust movement outward of the closing lever (6). It should be noted that, once the latch closing is activated, it is not possible to open the hook trying to move the closing lever in the opposite direction since at the moment of hoisting the load; the big-bag handles remain effectively restraining the pivoting triggers (13) due to the load weight.

Therefore, when the load is lifting, the axial cams (15*c*, 15*p*) match each other, positioning the arms, the sliding latches (4) and closing the bottom part of the inverted hooks (5) which remain firmly in their position thanks to the own load of the big-bag, thus being possible to safely transport the load to destination.

Figure 2:
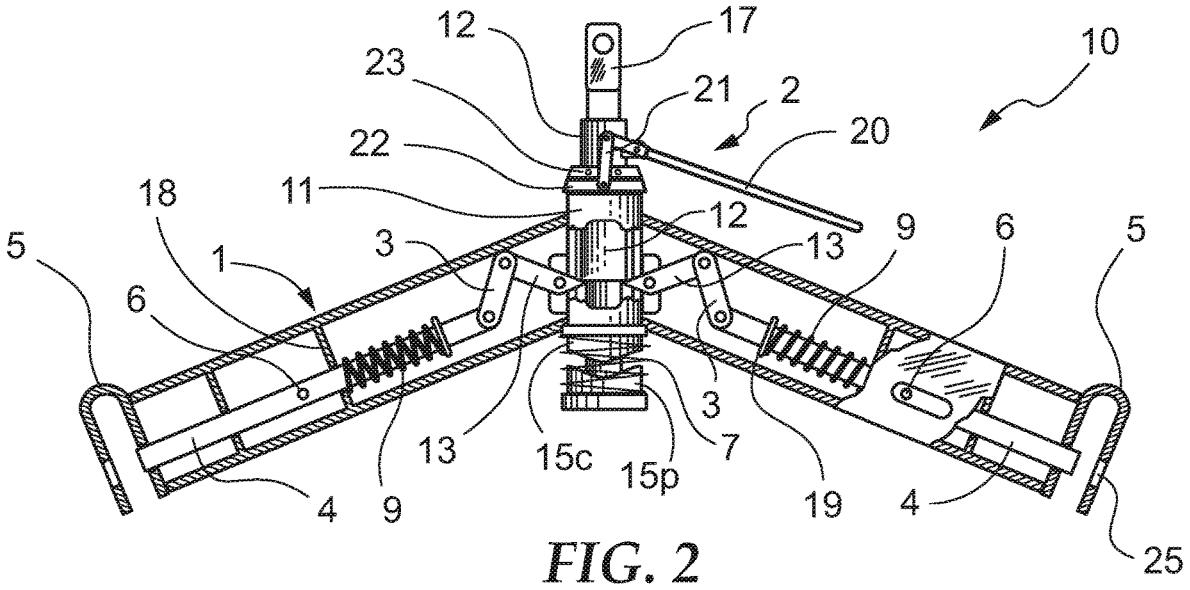
FIG. 2 is a side view of a partial cut of the lifting hanger purpose of this invention according to a first preferable embodiment, with the latches in open position.

Once the big-bag (14) has been carried to destination, the manner to release it is lowering the hanger (10) until resting the big-bag in such a way that the handles (16) are relaxed and then with the continuous lowering of the central passing-through pin (12) since the hanger arms put pressure against the load, this produces the triggering scale (8) (recess in diameter) to pull the innermost end of a plurality of pivoting triggers (13) causing the "triggering" retraction of the sliding latches (4) (See FIG. 2) and in this way the so called automatic triggering is achieved. Namely, the innermost end of each of said plurality of pivoting triggers (13) interferes with the vertical movement path of said triggering scale (8) of said central passing-through pin (12). Retraction of sliding latches (4) pulls the corresponding intermediate hinged arms (3) when compelling the pivoting triggers (13) to turn, since all of them are pivoting. This is favored by the activation of the respective retraction springs (9) of latches which tend to retract the sliding latches (4) towards the center of the hanger (10). It is worth mentioning that the innermost ends of the pivoting triggers (13) are inserted inwardly of the central tubular casing (11) since the same have openings or slots for the insertion of said triggers; said openings, slots or grooves for passing or insertion of the triggers can be put into practice in a wide variety of embodiments.

As it is shown in the Figures, the arms (1) can share a similar structure to the ones in the figures, or they can adopt diverse variations of the same, completely covered or showing part of the inner mechanism, with inner walls, ribs, reinforcements, or similar. In this sense, the retraction springs (9) of latches, can be accommodated around the proper sliding latch (4) preferably cylindrical, and be retained in position between an inner wall (18) of the arm for spring stop and a ring (19) or fixed stop over the proper sliding latch (4). In this way, the retraction springs (9) of latches can accumulate elastic energy when the sliding latches (4) close and then they can release their energy to retract the sliding latches (4) at the moment of activating the corresponding pivoting triggers (13).

Notwithstanding the mentioned-above, and as somebody skilled in the art will understand, it is possible to complement this hanger with a lever mechanism for manual disengaging (2); in the event that a manual release or disengage by means of an operator is desirable, it is enough that this lever mechanism for manual disengaging (2) allows to activate the corresponding pivoting triggers (13) the same manner it has been explained above, that means forcing the thrust of the ends of the triggers downwards.

In particular, as an example, a lever mechanism of disengagement for manual disengaging (2) can be put into practice by means of a lever (20) itself, connected in a pivoting way with the central passing-through pin (12) as it is shown in FIG. 1, arranging a hinged pull-rods (21) in the innermost end, which allows to pull by means of rotating collar (22) in such a way that forces the casing (11) to rise with respect to the central passing-through pin (12), and consequently, making the triggering scale (8) to push and trigger all the triggers (13) in such a way that forces the sliding latches (4) to adopt a close position, therefore releasing the load, namely, disengaging the handles of the big-bag. Thus, and in order to achieve a manual disengaging mechanism, the hanger includes a lever (20) connected in a pivoting way with the central passing-through pin (12) arranging in it innermost end a hinged pull-rods (21) which allows to pull a rotating collar (22) in such a way that forces the casing (11) to slide with respect to said central passing-through pin (12), as a follower of the movement of said lever, for example, particularly the casing includes a circular groove where the rotating collar (22) inserts, such as for example when conveniently put into practice with a ring (23) screwed or adjusted over the end upper part of the same central tubular casing (11) as it is shown in the figures.

It must be observed that, both the interaction of the triggering scale (8) with the triggers (13) and the interaction of the collar (22) with the casing (11) is rotating, which allows the freedom of positioning above mentioned, that is to say the turn and adjustments of the hanger to engage the load conveniently and the work of the axial cams of casing and pin (15*c*, 15*p*) to align the load during the lifting of the same. Therefore, it has been illustrated and described the convenience of the automatic triggering mechanism of the hanger proposed by this invention which enables a fast lifting and an automatic release of big-bags in the may described above.

What is claimed is:

1. A hanger with automatic triggering mechanism for lifting big-bags with multiple handles comprising:

a plurality of arms (1) which protrude longitudinally and radially from a central tubular casing (11), each one of the plurality of arms having end with a hook;

wherein each of the hooks is an inverted hook (5) having a bottom opening that is closed by a sliding latch (4) thus allowing to achieve:

an open hook position which is obtained by lowering a central passing-through pin (12) that slides vertically inside said central tubular casing (11), wherein said central passing-through pin (12) includes a downwards recess in diameter forming a triggering scale (8) to push downwards a bottom end of each one of a plurality of pivoting triggers (13), in such a way that said sliding latch (4), an intermediate hinged arm (3), and said pivoting trigger (13) are misaligning and therefore provoking the retraction of said sliding latch (4) towards the position of the open hook position; and a closed hook position which corresponds with the alignment of said sliding latch (4), said intermediate hinged arm (3), and said pivoting trigger (13) by the sliding of a closing lever (6), remaining the innermost end of said pivoting trigger interfering with a vertical movement path of said triggering scale (8) of said central passing-through pin (12).

2. The hanger according to claim 1, wherein the hanger further includes, in a bottom end of the central tubular casing (11), a tubular hub having a crescent shape which forms an axial cam (15*c*) of the casing, which axial support track corresponds with the axial support track of a lower axial cam (15*p*) of the central passing-through pin (12).

3. The hanger according to claim 1, wherein the hanger further includes a lever (20) pivoting connected with the central passing-through pin (12) arranging said lever in its innermost end, a hinged pull-rods (21) that allows to pull a rotating collar (22) in such a way that forces the central tubular casing (11) to slide with respect to said central passing-through pin (12), as a follower of the movement of said lever (20).

* * * * *